US011786913B2

(12) United States Patent
Abang et al.

(10) Patent No.: US 11,786,913 B2
(45) Date of Patent: Oct. 17, 2023

(54) Y-SHAPED MAGNETIC FILTRATION DEVICE

(71) Applicant: Saudi Arabian Oil Company, Dhahran (SA)

(72) Inventors: Taib Abang, Dhahran (SA); Muhammad Rizwan Tariq, Dhahran (SA); Mokhtarudin Abdul Razak, Dhahran (SA); Mohammad Boobaid, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 42 days.

(21) Appl. No.: 17/320,512

(22) Filed: May 14, 2021

(65) Prior Publication Data

US 2022/0362782 A1 Nov. 17, 2022

(51) Int. Cl.
*B03C 1/033* (2006.01)
*B03C 1/28* (2006.01)

(52) U.S. Cl.
CPC ..... *B03C 1/0335* (2013.01); *B03C 1/288* (2013.01); *B03C 2201/20* (2013.01)

(58) Field of Classification Search
CPC ... B03C 1/0335; B03C 1/288; B03C 2201/20; B03C 1/0355; B01D 46/0034
USPC ..... 96/2
See application file for complete search history.

(56) References Cited

U.S. PATENT DOCUMENTS 4,157,247 A 6/1979 Collins, III et al.
4,466,946 A 8/1984 Goddin, Jr. et al.
4,589,896 A 5/1986 Chen et al.
4,701,187 A 10/1987 Choe
(Continued)

FOREIGN PATENT DOCUMENTS

CA 2968601 6/2016
CN 105603911 A * 5/2016 ..... E01F 13/046
(Continued)

OTHER PUBLICATIONS

Black Powder Solutions, Water Treatment with Magnetic Separation, 1-16 (Year: 2020).*
(Continued)

*Primary Examiner* — Gene O Crawford
*Assistant Examiner* — Muhammad Awais
(74) *Attorney, Agent, or Firm* — Fish & Richardson P.C.

(57) ABSTRACT

The present disclosure describes a filtration device that includes a housing that includes a first tubular section connected to a second tubular section, wherein the first tubular section extends along a longitudinal axis and includes an open end that forms a fluid inlet of the housing, a closed end opposite the open end, and a connection opening positioned between the open and closed ends, and wherein the second tubular section includes a first open end connected to the connection opening of the first tubular section and a second open end that forms a fluid outlet of the housing; and a filter that is arranged inside of the first tubular section and that extends along the longitudinal axis of the first tubular section; wherein the filter includes an electromagnet configured to generate a magnetic field that surrounds at least the first tubular section and attracts metal contaminants in a fluid to the filter. A filter system is also described.

17 Claims, 8 Drawing Sheets

(56) References Cited

U.S. PATENT DOCUMENTS

| | | | | |
|---|---|---|---|---|
| 4,717,407 | A | 1/1988 | Choe et al. | |
| 5,401,300 | A | 3/1995 | Lokhandwala et al. | |
| 5,407,466 | A | 4/1995 | Lokhandwala et al. | |
| 5,407,467 | A | 4/1995 | Lokhandwala et al. | |
| 5,632,803 | A | 5/1997 | Stoner | |
| 5,647,993 | A * | 7/1997 | Karp | B03C 1/288 210/695 |
| 5,718,822 | A * | 2/1998 | Richter | B01D 35/143 210/90 |
| 5,837,032 | A | 11/1998 | Moll et al. | |
| 6,179,900 | B1 | 1/2001 | Behling et al. | |
| 6,361,582 | B1 | 3/2002 | Pinnau et al. | |
| 6,656,249 | B1 | 12/2003 | Buisnnan | |
| 6,896,717 | B2 | 5/2005 | Pinnau et al. | |
| 8,722,003 | B1 | 5/2014 | Avagliano et al. | |
| 8,828,121 | B1 | 9/2014 | He et al. | |
| 9,463,470 | B2 * | 10/2016 | Murahashi | B03C 1/034 |
| 10,967,312 | B2 * | 4/2021 | Richter | B01D 35/02 |
| 2004/0025485 | A1 * | 2/2004 | Lee | B01D 46/2414 55/486 |
| 2005/0217479 | A1 | 10/2005 | Hale et al. | |
| 2010/0264014 | A1 | 10/2010 | Mignon et al. | |
| 2011/0138854 | A1 | 6/2011 | Huang et al. | |
| 2012/0111051 | A1 | 5/2012 | Kulkarni et al. | |
| 2012/0168154 | A1 | 7/2012 | Chinn et al. | |
| 2012/0282378 | A1 * | 11/2012 | Mathews | A23L 2/04 29/592.1 |
| 2012/0323059 | A1 | 12/2012 | Liu et al. | |
| 2013/0256233 | A1 * | 10/2013 | Danov | B03C 1/0335 210/695 |
| 2015/0165448 | A1 * | 6/2015 | Adey | B01D 21/2411 285/119 |
| 2015/0240717 | A1 | 8/2015 | Starcher et al. | |
| 2015/0290575 | A1 | 10/2015 | Rothermel et al. | |
| 2015/0298972 | A1 | 10/2015 | Ballaguet et al. | |
| 2016/0008821 | A1 * | 1/2016 | Yount | B03C 1/0332 210/222 |
| 2016/0121258 | A1 | 5/2016 | First | |
| 2016/0228813 | A1 | 8/2016 | Schwartz | |
| 2017/0312682 | A1 | 11/2017 | Keller | |
| 2017/0320736 | A1 | 11/2017 | Voss et al. | |
| 2020/0129990 | A1 * | 4/2020 | Lee | B03C 1/0332 |
| 2021/0031139 | A1 | 2/2021 | Hamad et al. | |

FOREIGN PATENT DOCUMENTS

| | | | | |
|---|---|---|---|---|
| CN | 106076611 | A * | 11/2016 | |
| CZ | 2019567 | A3 * | 9/2019 | |
| CZ | 2019567 | A3 * | 8/2020 | |
| EP | 684066 | | 11/1995 | |
| EP | 2524730 | A2 * | 11/2012 | B03C 1/0332 |
| FR | 2982502 | A1 * | 5/2013 | B01D 29/27 |
| JP | H0768109 | * | 3/1995 | |
| JP | H0768109 | A * | 3/1995 | |
| JP | H1147632 | A * | 2/1999 | |
| KR | 20130001697 | U * | 3/2013 | |
| KR | 102111084 | B1 * | 12/2019 | |
| KR | 102111084 | B1 * | 5/2020 | |
| KR | 102200860 | | 1/2021 | |
| KR | 102200860 | B1 * | 1/2021 | |
| KR | 20130001697 | U * | 3/2023 | |
| RU | 117308 | U1 * | 6/2012 | |

OTHER PUBLICATIONS

MetraFlex, The Lowest Pressure Drop Y-Strainer, 1-2 (Year: 2019).*
One Eye Industries, Y-Strainer Series, 1-12 (Year: 2019).*
ITap, The Elimination of Impurities in Heating System, 1-20 (Year: 2021).*
PKP, Y-Strainer (Year: 2019).*
Black Powder Solutions, "Magnetic Separation Technology Erosion & Corrosion Management," 2020, 39 pages.
Eclipse Magnetics, "Magnetic filtration Sub-micron filtration for industrial fluids in precision applications," 2020, 17 pages.
lenntech.com [online], "Y-Strainer Application Information," available on or before Oct. 19, 2009, via Wayback Machine URL <http://web.archive.org/web/20091023010955/http://www.lenntech.com/systems/sediment/y/y-strainer.htm>, retrieved on Mar. 10, 2021, URL <https://www.lenntech.com/systems/sediment/y/y-strainer.htm>, 1 page.

* cited by examiner

Y-SHAPED MAGNETIC FILTRATION DEVICE

TECHNICAL FIELD

This disclosure relates to a filtration device for removing solid contaminants from a fluid flow.

BACKGROUND

Filtration devices are often used to separate solid contaminants from a flowing fluid. For instance, streams of gas in a gas processing plant may include solid contaminants such as sludge, scale, sand, and black powder that includes iron oxides and iron sulfides. Solid contaminants accumulate inside of process vessels at the inlet facility of a gas processing plant. Filtration devices generally include a housing and a filter medium arranged inside of the housing. The filter medium has a structure that allows only the fluid to pass through.

SUMMARY

In an example implementation, a filtration device includes a housing that includes a first tubular section connected to a second tubular section, wherein the first tubular section extends along a longitudinal axis and includes an open end that forms a fluid inlet of the housing, a closed end opposite the open end, and a connection opening positioned between the open and closed ends, and wherein the second tubular section includes a first open end connected to the connection opening of the first tubular section and a second open end that forms a fluid outlet of the housing; and a filter that is arranged inside of the first tubular section and that extends along the longitudinal axis of the first tubular section; wherein the filter includes an electromagnet configured to generate a magnetic field that surrounds at least the first tubular section and attracts metal contaminants in a fluid to the filter.

In an aspect combinable with the example implementation, the filtration device includes a pressure detector configured to measure a pressure differential inside the housing between the fluid inlet and the fluid outlet; and a controller configured to control the electromagnet based on the pressure differential.

In another aspect combinable with the example implementation, the filter includes a filter tube having a plurality of perforations that extend through a surface of the filter tube, and the electromagnet includes a wire that forms coils around the surface of the filter tube.

In another aspect combinable with the example implementation, the filtration device includes a power supply coupled to the electromagnet, wherein the power supply includes a variable resistor.

In another aspect combinable with the example implementation, the electromagnet is a first electromagnet, and the filtration device further including a second electromagnet that includes a wire that forms coils around an outer surface of the first tubular section.

In another aspect combinable with the example implementation, the filter tube is an outer filter tube, and the filter includes an inner filter tube that extends inside the outer filter tube and includes a plurality of perforations that extend through a surface of the inner filter tube and are smaller than the perforations of the outer filter tube.

In another aspect combinable with the example implementation, the filtration device includes an inlet adapter that connects to the fluid inlet of the housing; and an outlet adapter that connects to the fluid outlet of the housing; wherein the inlet adapter and outlet adapter are arranged coaxially and are each configured to connect the filtration device to piping.

In another aspect combinable with the example implementation, the first tubular section forms an angle of 30° to 60° relative to a longitudinal axis of the inlet adapter.

In another aspect combinable with the example implementation, the second tubular section forms an angle of 45° to 90° relative to the first tubular section.

In a further example implementation, a filter system for a gas processing facility includes an inlet configured for connection to a first pipe; an outlet configured for connection to a second pipe; a filtration device arranged between the inlet and the outlet, the filtration device including a housing that includes a first tubular section connected to a second tubular section, wherein the first tubular section extends along a longitudinal axis and defines an open end in fluid communication with the inlet, a closed end opposite the open end, and a connection opening positioned between the open and closed ends, and wherein the second tubular section defines a first open end connected to the connection opening of the first tubular section and a second open end in fluid communication with the outlet, and a filter that is arranged inside of the first tubular section and that extends along the longitudinal axis of the first tubular section, wherein the filter includes an electromagnet configured to generate a magnetic field that surrounds at least the first tubular section and attracts metal contaminants in a fluid to the filter; a first isolation valve arranged between the inlet and the open end of the first tubular section; and a second isolation valve arranged between the outlet and the second open end of the second tubular section.

In an aspect combinable with the example implementation, the inlet has an inlet opening with a diameter that corresponds to an inner diameter of the first pipe, wherein the first tubular section has an inner diameter that ranges from about 2 to 3 times the diameter of the inlet opening.

In another aspect combinable with the example implementation, a length of the first tubular section along its longitudinal axis ranges from about 5 to 6 times the diameter of the inlet opening.

In another aspect combinable with the example implementation, the filter system includes a bypass line that includes a first end, a second end, and a bypass valve arranged between the first and second ends, wherein the first end of the bypass line is arranged between the inlet and the first isolation valve, and the second end of the bypass line is arranged between the outlet and the second isolation valve.

In another aspect combinable with the example implementation, the housing includes a removable cover arranged at the closed end of the first tubular section, wherein the cover is configured to close an opening sized such that the filter can pass through the opening.

In another aspect combinable with the example implementation, the filter system includes a pressure detector configured to measure pressure at the inlet and the outlet; and controller configured to control the electromagnet based on a difference in the pressure detected at the inlet and outlet.

In another aspect combinable with the example implementation, the filter includes a filter tube having a plurality of perforations that extend through a surface of the filter tube, and the electromagnet includes a wire that forms coils around the surface of the filter tube.

In another aspect combinable with the example implementation, the electromagnet is a first electromagnet, the filtration device further including a second electromagnet that includes a wire that forms coils around an outer surface of the first tubular section.

In another aspect combinable with the example implementation, the filter tube is an outer filter tube, and the filter includes an inner filter tube that extends inside the outer filter tube and includes a plurality of perforations that extend through a surface of the inner filter tube and are smaller than the perforations of the outer filter tube.

In another aspect combinable with the example implementation, the first tubular section forms an angle of 30° to 60° relative to a longitudinal axis of the inlet.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
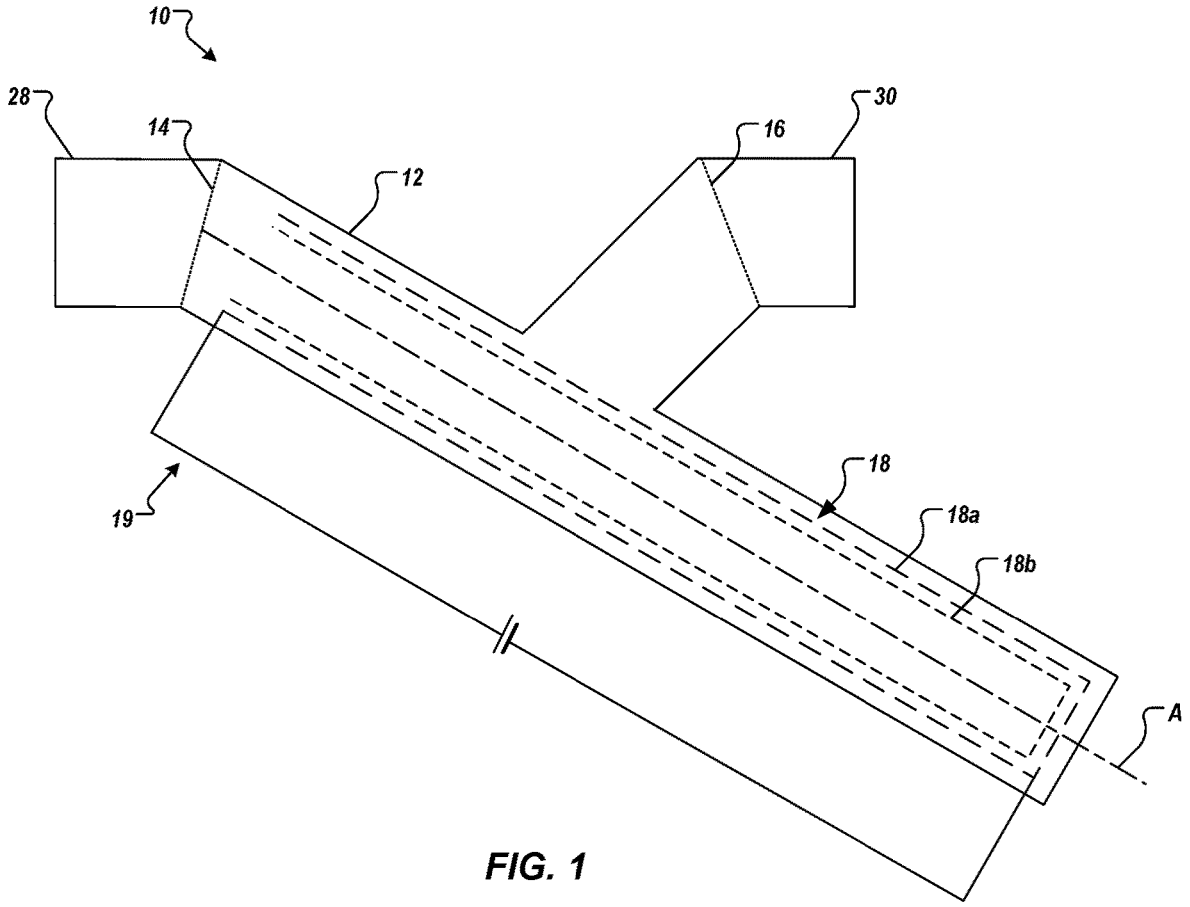
FIG. 1 is a schematic diagram of an example implementation of a filtration device according to the present disclosure.
Figure 2:
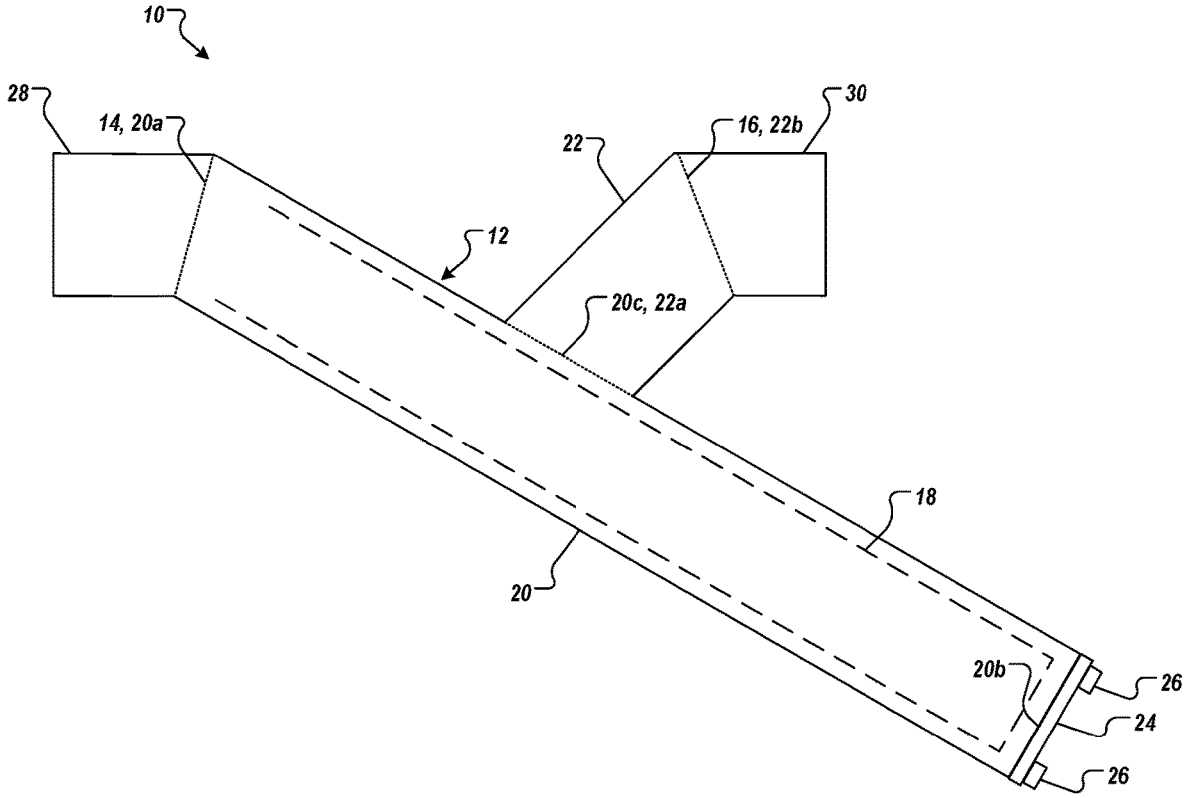
FIG. 2 is a schematic diagram that depicts details of the housing shown in FIG. 1.

Referring to FIGS. 1 and 2, an example implementation of a filtration device 10 is shown. Generally, the filtration device 10 includes a Y-shaped housing 12 that has a fluid inlet 14 and a fluid outlet 16, a filter 18 arranged inside the housing 12, and an electromagnet configured to generate a magnetic field that attracts metal contaminants suspended in the fluid to the filter 18 (FIG. 4). For example, the fluid inlet 14 may be connected to a gas feed stream and the fluid outlet 16 may be connected to the inlet of a slug catcher in a gas processing facility (FIG. 5). The metal contaminants trapped by the filtration device 10 may be iron oxides and iron sulfides that are found in so-called "black powder."

Black powder has a tendency to accumulate inside of process vessels at the inlet facility of gas processing facilities. When the amount of water produced by a reservoir increases, the water and black powder react to form a harmful corrosion product. Furthermore, black powder can clog nozzles that are used for level measurements in the process vessels, which negatively impacts the level control system and separation process inside of the vessels. Inaccuracies in the level control system and separation process may ultimately impact the quality of the hydrocarbon condensate produced by the gas processing facility.

As illustrated in FIG. 1, the filter 18 may have a basket shape with one open end facing the fluid inlet 14 and a closed end opposite the open end. In some cases, the filter 18 may have two open ends. The cross-sectional shape of the filter 18 into and out of the page in FIGS. 1, 2 may be circular or elliptical. In some instances, filter 18 forms a substantially tubular structure with one or more open ends and is dimensioned to fit within a corresponding tubular housing 12. The filter 18 can include perforations or a mesh material that allow fluid to pass through the perforations or openings in the mesh. For example, the perforations may be formed as substantially round holes in a sheet of material. Round holes may be suited for trapping irregularly shaped particles of black powder. For example, round perforations can formed in a sheet of metal using later cutting techniques. The mesh material may be formed by interweaving or intertwining a plurality of wires with openings between adjacent wires.

As shown in FIG. 2, the filter 18 may be formed as one piece. In other implementations, such as the one shown in FIG. 1, the filter 18 may include two or more nested filter elements 18*a*, 18*b*. For example, an outer filter element 18*a* may have larger perforations than an inner filter element 18*b* nested within the outer filter element 18*a*. Although the filtration device 10 of FIG. 1 includes two filter elements 18*a*, 18*b*, other implementations may include additional filter elements with an even smaller perforation or opening size. For example, the smallest perforation or opening sizes can be used to filter sludge and other small contaminants that are not attracted by the magnetic field such as sand, gravel or clay.

The number of filter elements 18*a*, 18*b* and their respective perforation or opening sizes can be selected in consideration of the application, such as a particular stream of feed gas. In some examples, the outer first filter element can have a perforation or opening size of 1 mm or greater. The second filter element can have a perforation or opening size that ranges from approximately 0.1 to 1 mm. The third filter element can have a perforation or opening size that ranges from approximately 0.01 to 0.1 mm.

In FIG. 1, the two nested filter elements 18*a*, 18*b* have substantially equal lengths along a longitudinal axis A. In some implementations, the inner filter element 18*b* can have a shorter length than the outer filter element 18*a*. For example, the perforations or openings in the outer filter element 18*a* can be larger than those in the inner filter element 18*b*. The smaller perforations or openings in the inner filter element 18*b* can be used to filter small particles, such as sludge. Although it is desirable to filter sludge from the fluid passing through the filtration device 10, the small perforations or openings in the inner filter element 18*b* may reduce the overall flow rate to below an acceptable value. By reducing the length of the inner filter element 18*b* relative to the outer filter element 18*a*, the overall flow rate can be improved while continuing to capture larger particles with the filter element 18*a*.

Referring to FIG. 2, the Y-shaped housing 12 includes a first tubular section 20 connected to a second tubular section 22. The first tubular section 20 has an open end 20*a* that also forms the fluid inlet 14 of the housing 12, a closed end 20*b* that is opposite to the open end 20*a*, and a connection opening 20*c* positioned between the open end 20*a* and the closed end 20*b*. The second tubular section 22 has a first open end 22*a* that connects to the connection opening 20*c* of the first tubular section 20 and a second open end 22*b* that also forms the fluid outlet 16 of the housing 12.

According to implementations of the present disclosure, the filter 18 is arranged inside of the first tubular section 20 and extends along the longitudinal axis A of the first tubular section. The closed end 20*b* of the first tubular section 20 supports the filter 18 during fluid flow through the filtration device 10. In some cases, it may be necessary to remove the filter 18 for cleaning or maintenance. Accordingly, the closed end 20*b* of the first tubular section 20 may include a cover 24 and bolts 26 that attach the cover 24 to the first tubular section 20. The cover 24 can be removed to expose the end 20*b* of the first tubular section 20 so that the filter 18 can be removed, cleaned, and reinstalled. Thus, the filtration device 10 can be made of reusable parts as opposed to disposable cartridges or filter elements. Although the cover 24 and bolts 26 are shown schematically in FIG. 2, they may include additional fastening and sealing components so that the housing 12 can withstand pressure when the filtration device 10 is in operation. For example, a drain nozzle with an isolation valve can be installed on the cover 24 or on the housing 12 adjacent the closed end 20*b* of the first tubular section 20.

Figure 3A:
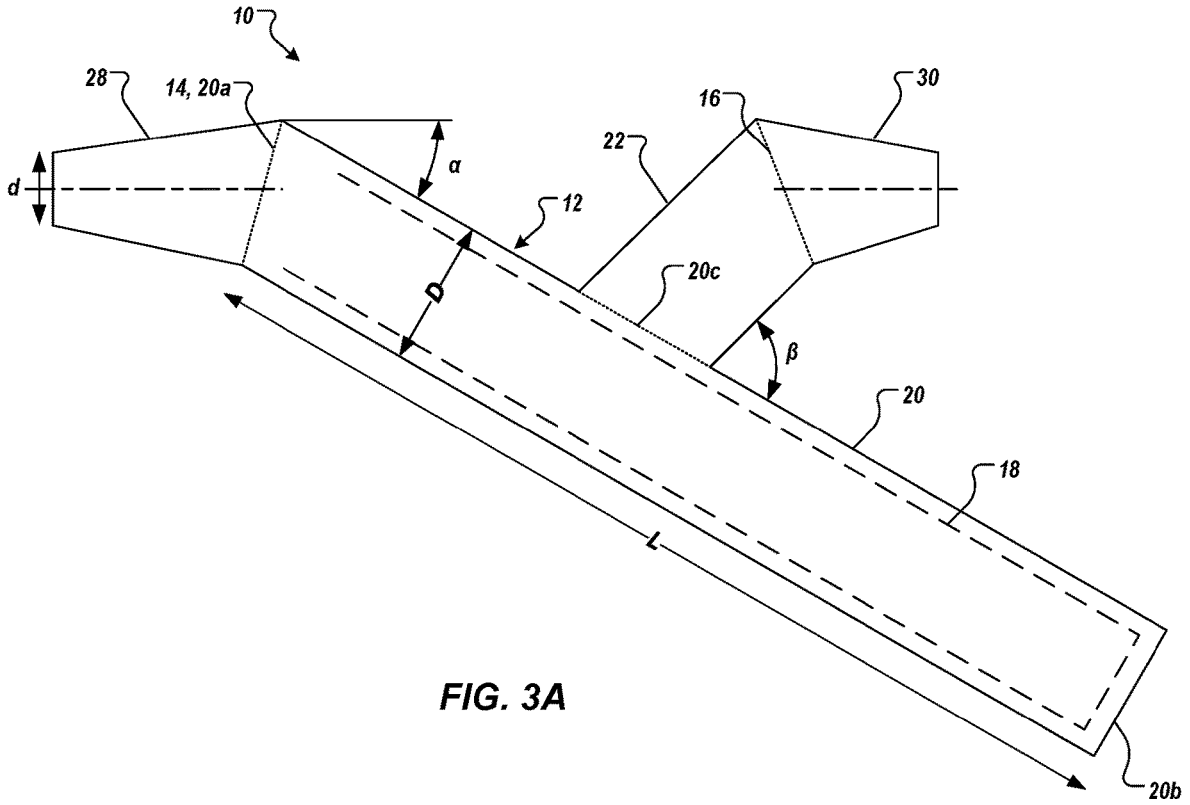
FIG. 3A to 3C are schematic diagrams that depict further details of the housing shown in FIG. 1.
Figure 3B:
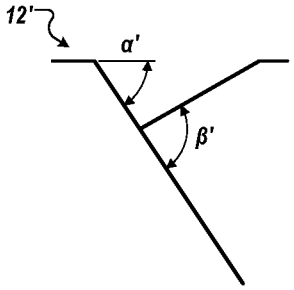
Figure 3C:
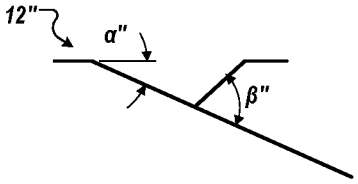

FIG. 3A to 3C schematically illustrate further details of the housing 12 of the filtration device 10 according to implementations of the present disclosure. For example, the fluid inlet 14 of the housing 12 can be connected to an inlet adapter 28 and the fluid outlet 16 of the housing 12 can be connected to an outlet adapter 30. In some cases, the inlet adapter 28 and the outlet adapter 30 are arranged coaxially to one another, which makes it possible to install the filtration device 10 at an existing pipe connected to the inlet of a slug catcher, for example. Although the inlet adapter 28 and the outlet adapter 30 are shown as tubular sections, they may also include flanges for connecting the filtration device 10 to external pipe. The inlet adaptor 28 and the outlet adaptor 30 can also each include a vent nozzle with an isolation valve.

As shown in FIG. 3A, the first tubular section 20 extends downward from the center line of the external pipe at an angle $\alpha$. Due to the downward slant of the first tubular section 20, both gravitational and fluid velocity forces aid in the filtration of solid contaminants. In some implementations, the angle $\alpha$ can have a value of about 45°, for example, from 40° to 50°. The angle $\alpha$ can be increased for applications in which the inlet stream enters the fluid stream at a greater velocity. For example, FIG. 3B is a simplified depiction of a housing 12' that has a first tubular section that extends downward at an angle $\alpha'$ of about 60°. In comparison to the housing 12 in FIG. 3A, the angle $\alpha'$ increases the gravitational component of the forces that act on the particles, which is thought to increase the number of particles captured by the filtration device 10. Further, the increase in angle $\alpha'$ may also slow the flow rate of the inlet stream (e.g., 3 to 4.6 m/s or 10 to 15 ft/s) to capture more particles suspended in the inlet stream. FIG. 3C is a simplified depiction of a housing 12" that has a first tubular section that extends downwards at an angle $\alpha''$ of about 30°. Such an angle may be suitable for slower flow rates (e.g., 0.3 to 1.5 m/s or 1 to 5 ft/s). Thus, the angle $\alpha$ can have a value from about 30° to 60°.

In the illustrated implementations, the second tubular section 22 extends upwards and forms an angle $\beta$ relative to the first tubular section 22. When the filtration device 10 is used to filter black powder and sludge from a gas feed stream, the upward slant of the second tubular section 22 allows light process fluid to easily rise and flow towards the inlet of the slug catcher, for example. Although the angle $\beta$ can have a value from about 0° to 90°, in some implementations, the angle $\beta$ has a value from 45° to 90°, as shown by the angles $\beta'$ and $\beta''$ in FIGS. 3B and 3C.

As shown in FIGS. 1 and 2, the first tubular section 20, the second tubular section 22, the inlet adapter 28, and the outlet adapter 30 may all have the same cross-sectional shape and area to promote smooth fluid flow through the filtration device 10. The cross-sectional area may be larger than the cross-sectional area of external pipes to maintain both filtration and flow rate of the process fluid and to accommodate the filter 18 inside of the housing 12. As shown in FIG. 3A, the first tubular section 20 and the second tubular section 22 can have an outer diameter D that is about two to three times the size of a diameter d of the external pipes (not shown). The length L of the first tubular section 20 can range from five to six times the size of the diameter d of the external pipes in some implementations.

In the illustrated implementations, the filter 18 substantially extends from the open end 20*a* past the connection opening 20*c* of the first tubular section 20 to the closed end 20*b*. In operation, the fluid flows through the first tubular section 20 between the open end 20*a* and the connection opening 20*c*. Some fluid may enter the part of the first tubular section 20 closer to the closed end 20*b*, but it will exit through connection opening 20*c*. In order to modify the flow rate through the filtration device 10, a length of the filter 18 can be adapted relative to the length of the first tubular section 20.

Figure 4A:
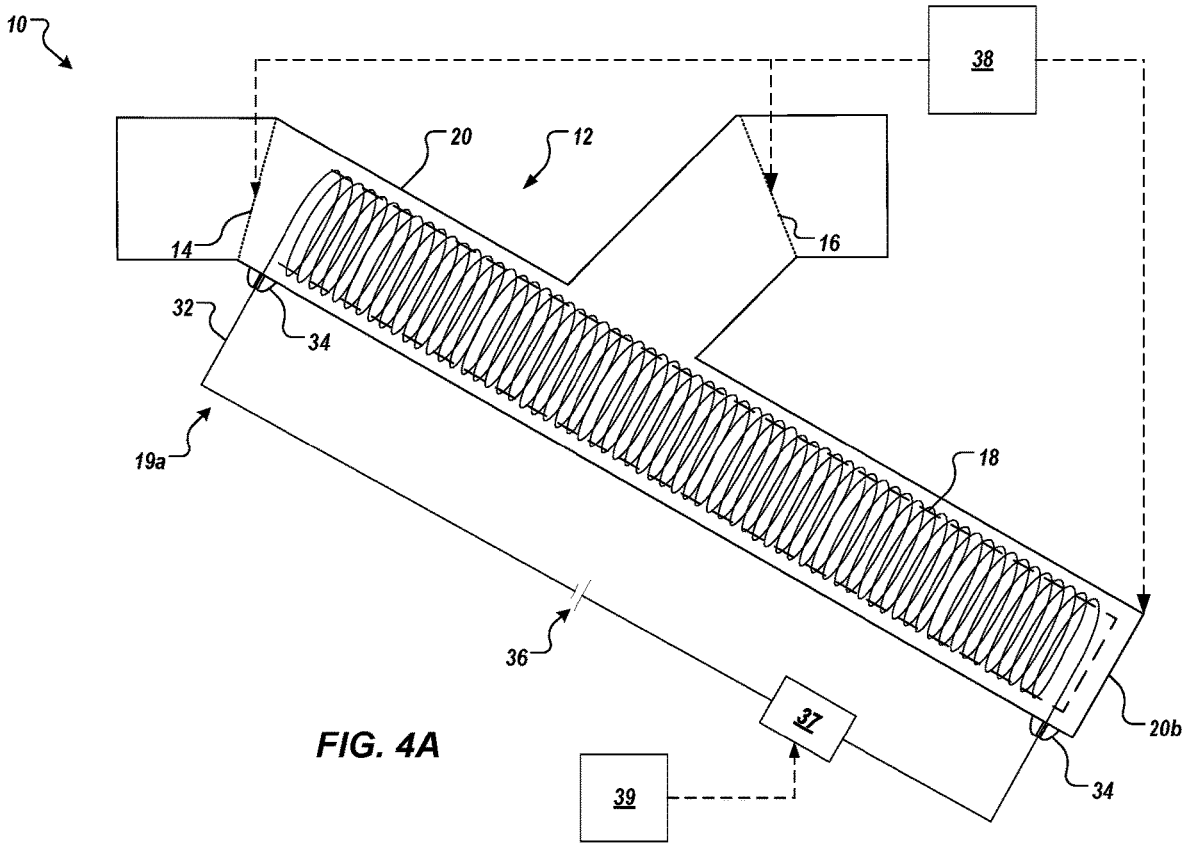
FIG. 4A to 4C are schematic diagrams that depict details of the electrical circuit shown in FIG. 1.
Figure 4B:
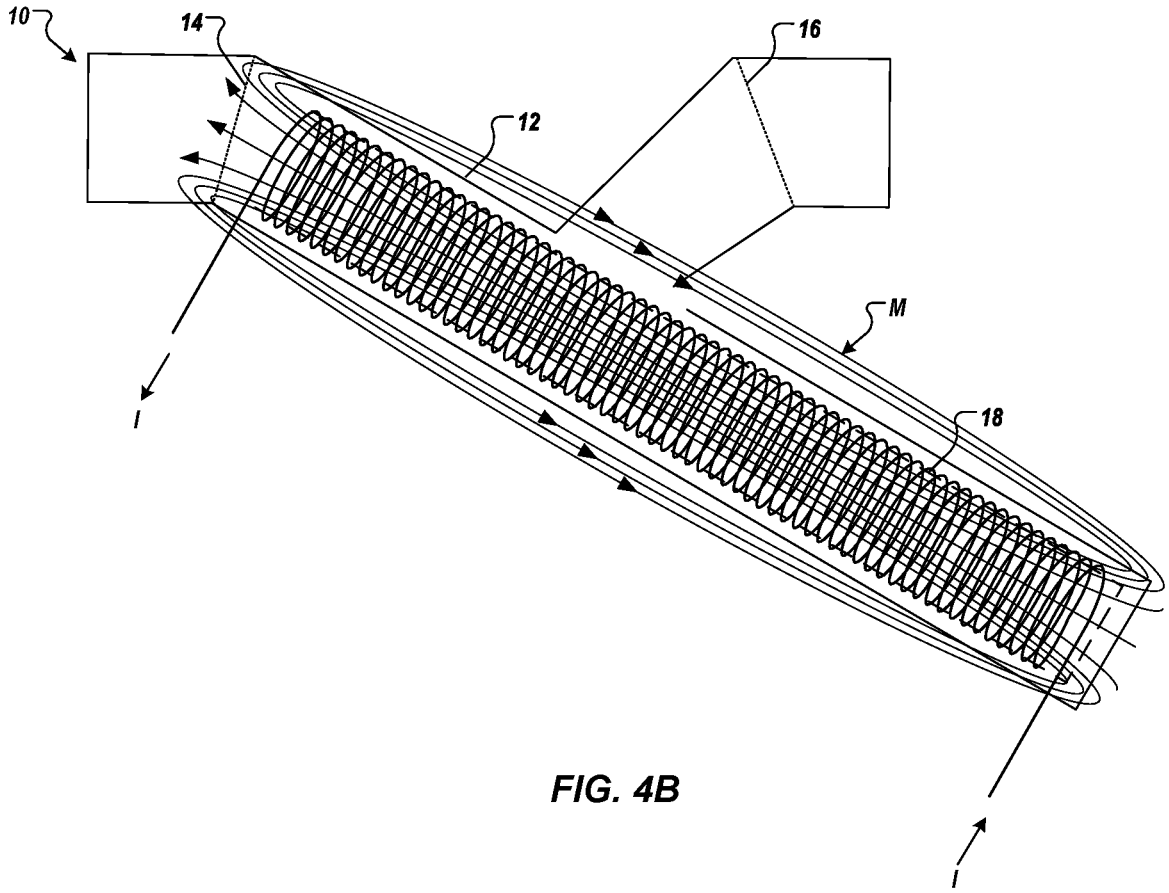
Figure 4C:
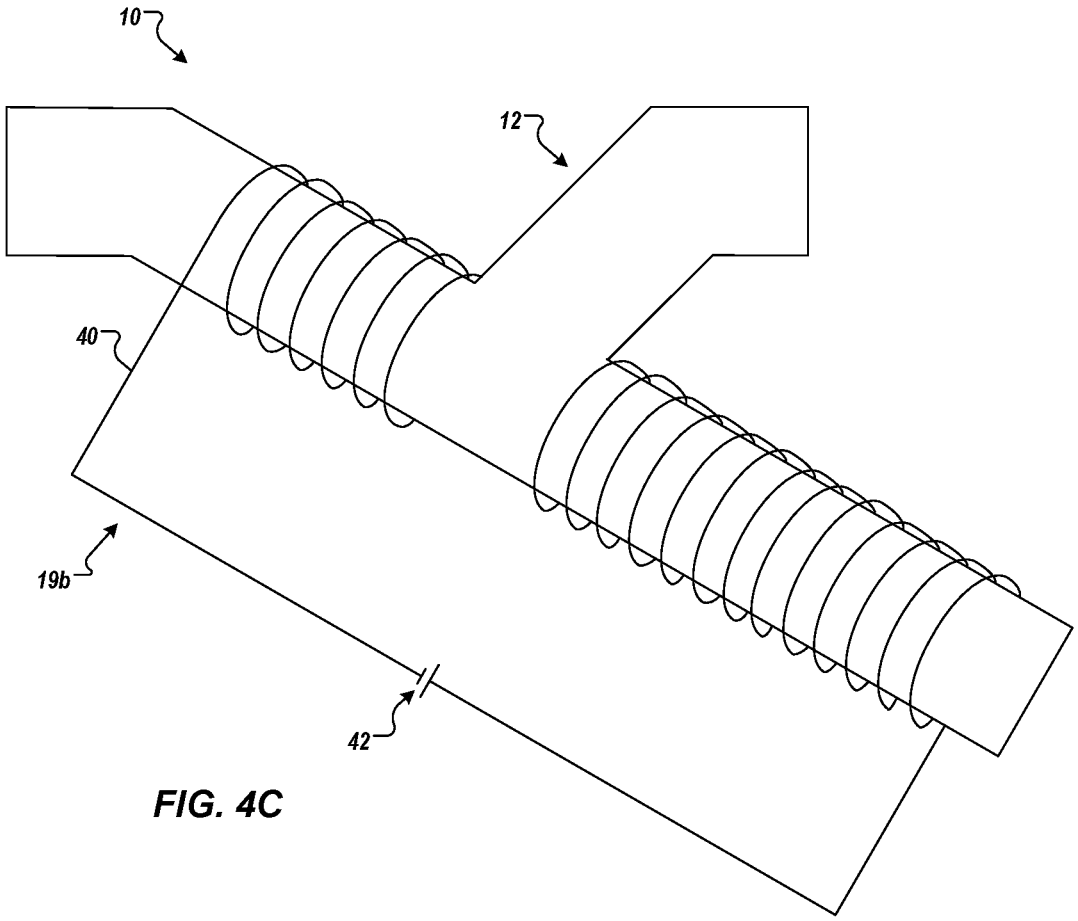
Figure 5:
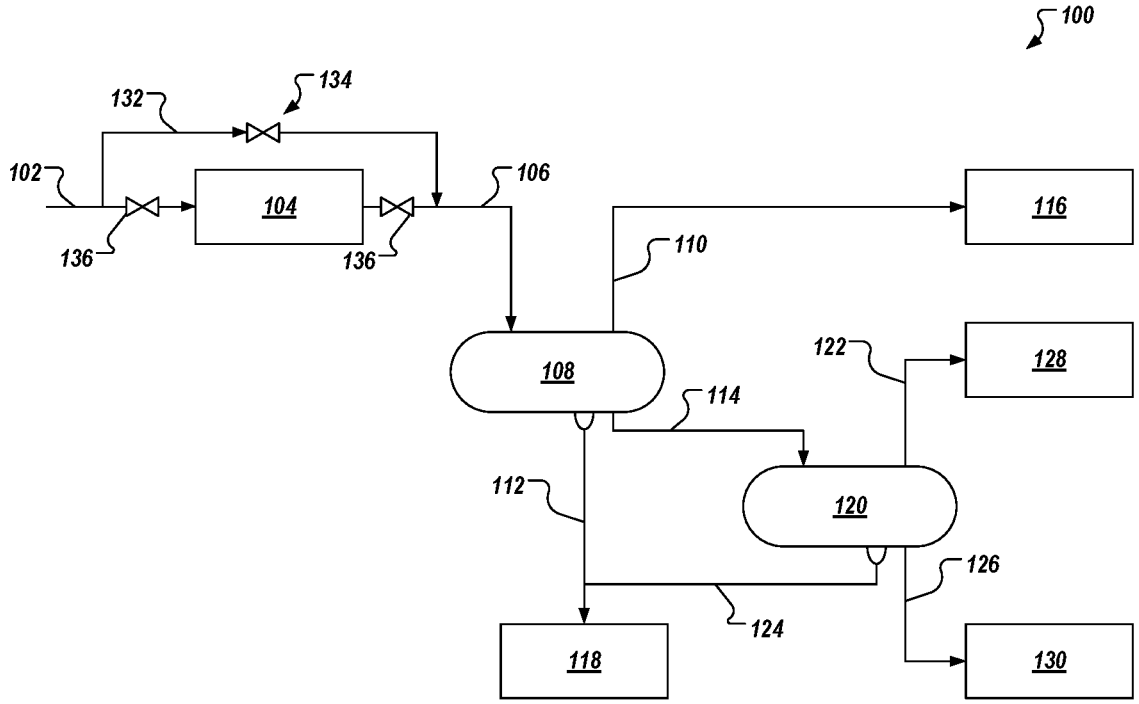
FIG. 5 is a schematic diagram of an example gas processing facility that includes a filtration device according to the present disclosure.

FIG. 4A to 4C are schematic diagrams that depict details of the electrical circuit 19 configured to generate a magnetic field and attract metal contaminants to the filter 18. FIG. 4A depicts an example circuit 19*a* that includes a wire 32 wrapped around an outer surface of the filter 18. The ends of the wire 32 extend through cable glands 34 that are provided at opposite ends of the first tubular section 20. The ends of the wire 32 are connected to terminals of a power supply 36. As current I passes through the wire 32, a magnetic field M is produced, as shown in FIG. 4B. Note that the cable glands 34 and power supply 36 are not shown in FIG. 4B.

In the illustrated implementation, filter 18 is includes or is made from ferromagnetic or ferrimagnetic material, such that at least a portion of the filter 18 forms a magnetic core of an electromagnet. Examples of ferromagnetic material are iron, cobalt, nickel, and several of their alloys. Magnetite is an example of a ferrimagnetic material. In implementations of the filtration device 10 that include more than one filter element 18*a*, 18*b*, the material of at least the outer filter element 18*a* can be ferromagnetic or ferrimagnetic material. In some cases, the one or more inner filter elements 18*b* that are nested inside of the outer filter element 18*a*, 18*b* can also be made of ferromagnetic or ferrimagnetic material. In these cases, the entire filter 18 can form a magnetic core of an electromagnet. However, it is also conceivable that only the filter element 18*a* that is configured to capture metallic particles is made of ferromagnetic or ferrimagnetic material.

The electric circuit 19*a* of FIG. 4A can have a fixed current or a time varying current. In some instances, the resultant magnetic field can be varied in response to operational conditions. For example, the current I can be varied in response to the pressure differential between the fluid inlet 14 and the fluid outlet 16. The filtration device 10 can include a pressure detector 38 that is configured to measure the pressure differential between the fluid inlet 14 and fluid outlet 16. In some examples, the pressure detector 38 may be a differential pressure transducer.

The pressure differential is related to the amount of solids that are filtered from the flowing fluid. The pressure at the fluid inlet 14 drives the fluid through the filtration device 10. Initially, when the filtration device 10 is free of contaminants, the downstream pressure at the fluid outlet 16 is substantially equal to the upstream pressure at the fluid inlet 14. As particles accumulate in the filter 18, the downstream pressure at the fluid outlet 16 drops relative to the upstream pressure at the fluid inlet 14. Thus, the increase in differential pressure indicates that solids are being captured by the filter 18. If the differential pressure at any point in time is lower than desired or is increasing too slowly, the filtration device 10 can be configured to increase the current I through the wire to adjust the magnetic field M (FIG. 4B). For the sake of simplicity, the pressure detector 38 is not shown in FIG. 4B. For example, the electric circuit 19*a* can include a variable resistor 37 to vary the current I. The variable resistor 37 can be controlled by a controller 39 based on input from the pressure detector 38. The current I through the wire 32 wrapped around the filter 18 can be capped (e.g., at 500 mA) for safe operation of the filtration device 10. This is to ensure that electrical energy within the internal housing is below than the level which can cause ignition.

In some cases, the pressure detector 38 is configured to additionally measure the pressure at the closed end 20*b* of the first tubular section 20 to provide additional information for controlling the current I through the electric circuit 19*a*.

FIG. 4C depicts the filtration device 10 of FIGS. 4A and 4B from the outside. In the illustrated implementation, a wire 40 is wrapped around the outside of the housing 12. The ends of the wire 40 are connected to a power supply 42 to form a further electrical circuit 19*b*. A material of the housing 12 (or at least the first tubular section 20) is ferromagnetic or ferrimagnetic material, such that the first tubular section 20 forms a magnetic core of an electromagnet. The current in the electrical circuit 19*b* can be a fixed current or a variable current, as described previously for the electrical circuit 19*a*. Since the risk for explosion is lower for the wire 40 that is wrapped around the outside of the housing, the current for the electrical circuit 19*b* is not necessarily capped at 500 mA. For example, the current for the electrical circuit 19*b* can be capped so that electrical energy exposed to explosive atmosphere is below than the level which it can ignite. Although they are not shown in FIG. 4C, the electrical circuit 19*b* can also include the variable resistor 37 and the controller 39 depicted in FIG. 4A.

Implementations of the filtration device 10 can include either the inner electrical circuit 19*a* only, the outer electrical circuit 19*b* only, or both the inner and outer electrical circuits 19*a*, 19*b*.

In implementations with both the inner and outer electrical circuits 19*a*, 19*b*, the wires 32, 40 are wound in the same direction, and current flows through both circuits 19*a*, 19*b* in the same direction. In such implementations, the inner and outer electrical circuits 19*a*, 19*b* can be controlled independently of one another. For example, the inner electrical circuit 19*a* can be powered off at the same time that current flows through the outer electrical circuit 19*b*. In another example, the current through the inner electrical circuit 19*a* may have reached a maximum safe current. In order to adjust the magnetic field, the current through the outer electrical circuit 19*b* may be increased while maintaining a stable (or even fixed) current through the inner electrical circuit 19*a*. For example, the controller 39 depicted in FIG. 4A can be used to control both the inner electrical circuit 19*a* and the outer electrical circuit 19*b*.

FIG. 5 is a schematic diagram of an example gas processing facility 100. A feed stream 102 enters the facility 100 from a production well. The feed stream 102 travels through a filtration device 104 in accordance with the present disclosure. The filtration device 104 can be the filtration device 10 of FIGS. 1 to 4. The filtration device 104 filters particles, such as black powder, sand, and sludge, from the feed stream 102. A filtered feed stream 106 travels from a fluid outlet of the filtration device 104 to a slug catcher 108.

The slug catcher 108 is designed to temporarily store surges or slugs in the filtered feed stream 106 and allow the feed stream 106 to flow to downstream equipment at more even rates. The slug catcher 108 separates the feed stream 106 into a gas stream 110, a water stream 112, and condensed hydrocarbon liquid 114. Since the filtered feed stream 106 is largely free of corrosion products, sand, sludge, and other contaminants, nozzles for level measurements in the slug catcher 108 and other downstream separation equipment are less likely to become clogged. Accurate level measurements improve the accuracy of level control and separation process inside the vessels and may improve crude quality. In the illustrated implementation, the slug catcher 108 comprises a knockout vessel. However, the slug catcher 108 can also be a pipe-type slug catcher.

The gas stream 110 can travel from the slug catcher 108 to a high-pressure diglycolamine (DGA) train 116. The DGA train 116 uses an aqueous amine solution to "sweeten" the gas stream 110 by removing hydrogen sulfide ($H_2S$) and carbon dioxide ($CO_2$). Other examples of amines that can be used to sweeten gas are diethanolamine (DEA), monoethanolamine (MEA), methyldiethanolamine (MDEA), diisopropanolamine (DIPA).

The water stream 112 can travel from the slug catcher 108 to a sour water stripper 118. The sour water stripper 118 can remove ammonia ($NH_3$) and hydrogen sulfide ($H_2S$) from the water stream 112 to condition the water stream 112 for discharge or reuse within the gas processing facility 100.

The condensed hydrocarbon liquid 114 can travel from the slug catcher to a three-phase separator 120. The separator 120 separates the stream of condensed hydrocarbon liquid 114 into a gas stream 122, a water stream 124, and condensed hydrocarbon liquid 126. The gas stream 122 can travel from the separator 120 to a low-pressure DGA train 128 to sweeten the gas stream 122. The water stream 124 can travel to the sour water stripper 124 to be conditioned for discharge or re-use.

The condensed hydrocarbon liquid 126 can travel to a condensate stabilization unit 130. The condensate stabilization unit 130 is designed to remove light components from the condensed hydrocarbon liquid 126 and lower its vapor pressure for transport through a pipeline or storage in a tank. The stabilization unit 130 may also reduce the amount of intermediate hydrocarbon components (propane and butane) that flash to the vapor state and increase the liquid products.

As described, a fluid inlet (not shown) of the filtration device 104 is connected to the feed stream 102 that travels from the production well. The gas processing facility 100 also includes a bypass line 132 connected in parallel to the filtration device 104. The bypass line 132 includes a bypass valve 134. The facility 100 also includes two isolation valves 136 that are immediately upstream and downstream of the filtration device 104. During normal operation of the facility 100, the bypass valve 134 is closed, and the isolation valves 136 are open. Thus, the feed stream 102 enters the filtration device 104 and exits as filtered feed stream 106.

During maintenance operations, isolation valves 136 are closed and the bypass valve 134 is opened. The feed stream 102 then flows along the bypass line 132 and into the slug catcher 108. After an initial depressurization operation, the filtration device 104 can be opened for maintenance. Referring again to FIG. 2, a bucket can be placed below the closed end 20*b* of the first tubular section 20. The bolts 26 and cover 24 can then be removed to access the filter 18. After cleaning, the filter 18 can be reinstalled in the first tubular section 20. Thus, the filtration device 10, 104 can be implemented without disposable cartridges or filter elements.

While the filtration device 104 is offline for maintenance and cleaning, an unfiltered stream can flow from the production well to the slug catcher 108 via the bypass line 132. In many cases, the filtration device 104 is only offline for a short duration. In some applications, the bypass line 132 and the bypass valve 134 can be replaced by a second filtration device and set of isolation valves (not shown). A parallel second filtration device allows an uninterrupted and filtered feed stream to flow to the slug catcher 108.

A number of implementations have been described. Nevertheless, it will be understood that various modifications may be made without departing from the spirit and scope of the disclosure. Accordingly, other implementations are within the scope of the following claims.

What is claimed is:

1. A filtration device comprising:

a housing that comprises a first tubular section connected to a second tubular section, wherein the first tubular section extends along a longitudinal axis and comprises an open end that forms a fluid inlet of the housing, a closed end opposite the open end, and a connection opening positioned between the open and closed ends, and wherein the second tubular section comprises a first open end connected to the connection opening of the first tubular section and a second open end that forms a fluid outlet of the housing;

a filter that is arranged inside of the first tubular section and that extends along the longitudinal axis of the first tubular section;

wherein the filter comprises an electromagnet configured to generate a magnetic field that surrounds at least the first tubular section and attracts metal contaminants in a fluid to the filter;

a pressure detector configured to measure a pressure differential inside the housing between the fluid inlet and the fluid outlet; and a controller configured to control the electromagnet based on the pressure differential.

2. The filtration device of claim 1, wherein the filter comprises a filter tube having a plurality of perforations that extend through a surface of the filter tube, and wherein the electromagnet comprises a wire that forms coils around the surface of the filter tube.

3. The filtration device of claim 2, further comprising a power supply coupled to the electromagnet, wherein the power supply comprises a variable resistor.

4. The filtration device of claim 2, wherein the electromagnet is a first electromagnet, the filtration device further comprising a second electromagnet that comprises a wire that forms coils around an outer surface of the first tubular section.

5. The filtration device of claim 2, wherein the filter tube is an outer filter tube, and wherein the filter comprises an inner filter tube that extends inside the outer filter tube and comprises a plurality of perforations that extend through a surface of the inner filter tube and are smaller than the perforations of the outer filter tube.

6. The filtration device of claim 1, further comprising:

an inlet adapter that connects to the fluid inlet of the housing; and an outlet adapter that connects to the fluid outlet of the housing;

wherein the inlet adapter and outlet adapter are arranged coaxially and are each configured to connect the filtration device to piping.

7. The filtration device of claim 6, wherein the first tubular section forms an angle of 30° to 60° relative to a longitudinal axis of the inlet adapter.

8. The filtration device of claim 7, wherein the second tubular section forms an angle of 45° to 90° relative to the first tubular section.

9. A filter system for a gas processing facility comprising:

an inlet configured for connection to a first pipe;

an outlet configured for connection to a second pipe;

a filtration device arranged between the inlet and the outlet, the filtration device comprising a housing that comprises a first tubular section connected to a second tubular section, wherein the first tubular section extends along a longitudinal axis and defines an open end in fluid communication with the inlet, a closed end opposite the open end, and a connection opening positioned between the open and closed ends, and wherein the second tubular section defines a first open end connected to the connection opening of the first tubular section and a second open end in fluid communication with the outlet, and a filter that is arranged inside of the first tubular section and that extends along the longitudinal axis of the first tubular section, wherein the filter comprises an electromagnet configured to generate a magnetic field that surrounds at least the first tubular section and attracts metal contaminants in a fluid to the filter;

a first isolation valve arranged between the inlet and the open end of the first tubular section;

a second isolation valve arranged between the outlet and the second open end of the second tubular section;

a pressure detector configured to measure pressure at the inlet and the outlet; and a controller configured to control the electromagnet based on a difference in the pressure detected at the inlet and outlet.

10. The filter system of claim 9, wherein the inlet has an inlet opening with a diameter that corresponds to an inner diameter of the first pipe, wherein the first tubular section has an inner diameter that ranges from about 2 to 3 times the diameter of the inlet opening.

11. The filter system of claim 10, wherein a length of the first tubular section along its longitudinal axis ranges from about 5 to 6 times the diameter of the inlet opening.

12. The filter system of claim 9, further comprising a bypass line that comprises a first end, a second end, and a bypass valve arranged between the first and second ends, wherein the first end of the bypass line is arranged between the inlet and the first isolation valve, and the second end of the bypass line is arranged between the outlet and the second isolation valve.

13. The filter system of claim 9, wherein the housing comprises a removable cover arranged at the closed end of the first tubular section, wherein the cover is configured to close an opening sized such that the filter can pass through the opening.

14. The filter system of claim 9, wherein the filter comprises a filter tube having a plurality of perforations that extend through a surface of the filter tube, and wherein the electromagnet comprises a wire that forms coils around the surface of the filter tube.

15. The filter system of claim 14, wherein the electromagnet is a first electromagnet, the filtration device further comprising a second electromagnet that comprises a wire that forms coils around an outer surface of the first tubular section.

16. The filter system of claim 14, wherein the filter tube is an outer filter tube, and wherein the filter comprises an inner filter tube that extends inside the outer filter tube and comprises a plurality of perforations that extend through a surface of the inner filter tube and are smaller than the perforations of the outer filter tube.

17. The filter system of claim 9, wherein the first tubular section forms an angle of 30° to 60° relative to a longitudinal axis of the inlet.

* * * * *